US009915966B2

(12) United States Patent
Chou et al.

(10) Patent No.: US 9,915,966 B2
(45) Date of Patent: Mar. 13, 2018

(54) BANDGAP REFERENCE AND RELATED METHOD

(71) Applicant: Taiwan Semiconductor Manufacturing Company, Ltd., Hsin-Chu (TW)

(72) Inventors: Chung-Cheng Chou, Hsin-Chu (TW); Yue-Der Chih, Hsin-Chu (TW)

(73) Assignee: Taiwan Semiconductor Manufacturing Company, Ltd., Hsin-Chu (TW)

( * ) Notice: Subject to any disclaimer, the term of this patent is extended or adjusted under 35 U.S.C. 154(b) by 211 days.

(21) Appl. No.: 13/973,459

(22) Filed: Aug. 22, 2013

(65) Prior Publication Data

US 2015/0054485 A1 Feb. 26, 2015

(51) Int. Cl.

| | |
|---|---|
| ***G05F 3/16*** | (2006.01) |
| ***G05F 3/18*** | (2006.01) |
| ***G05F 3/12*** | (2006.01) |
| ***G05F 3/30*** | (2006.01) |

(52) U.S. Cl.

CPC ..... *G05F 3/16* (2013.01); *G05F 3/12* (2013.01); *G05F 3/18* (2013.01); *G05F 3/30* (2013.01)

(58) Field of Classification Search

CPC ..... G05F 3/16

USPC ..... 323/312, 313, 314, 315, 316, 317; 327/538, 539, 543, 541

See application file for complete search history.

(56) References Cited

U.S. PATENT DOCUMENTS

| | | | | |
|---|---|---|---|---|
| 6,392,470 | B1 * | 5/2002 | Burstein | G05F 3/30 327/539 |
| 7,301,321 | B1 * | 11/2007 | Uang | G05F 3/262 323/313 |
| 7,768,248 | B1 * | 8/2010 | Hyde | G05F 3/24 323/315 |
| 2009/0001958 | A1 * | 1/2009 | Fujii | G05F 3/30 323/313 |
| 2009/0051341 | A1 * | 2/2009 | Chang et al. | 323/313 |
| 2009/0051342 | A1 * | 2/2009 | Peng et al. | 323/313 |
| 2009/0146625 | A1 * | 6/2009 | Huang | G05F 3/30 323/272 |
| 2011/0068756 | A1 * | 3/2011 | Hong | G05F 3/30 323/268 |
| 2011/0127988 | A1 * | 6/2011 | Harvey | G05F 3/30 323/313 |
| 2011/0187344 | A1 * | 8/2011 | Iacob | G05F 3/16 323/315 |

* cited by examiner

*Primary Examiner* — Jue Zhang
*Assistant Examiner* — Trinh Dang
(74) *Attorney, Agent, or Firm* — Slater Matsil, LLP

(57) ABSTRACT

A device includes a proportional-to-absolute-temperature (PTAT) current source having a bandgap reference voltage node, and a negative temperature dynamic load having an input terminal electrically connected to the bandgap reference voltage node.

20 Claims, 3 Drawing Sheets

BANDGAP REFERENCE AND RELATED METHOD

BACKGROUND

The semiconductor industry has experienced rapid growth due to improvements in the integration density of a variety of electronic components (e.g., transistors, diodes, resistors, capacitors, etc.). For the most part, this improvement in integration density has come from shrinking the semiconductor process node (e.g., shrinking the process node towards the sub-20 nm node).

Shrinking the semiconductor process node entails reductions in operating voltage and current consumption of electronic circuits developed in the semiconductor process node. For example, operating voltages have dropped from 5V to 3.3V, 2.5V, 1.8V, and even 0.9V. A wave of mobile device popularity has increased pressure in the industry to develop low power circuits that only drain minimal operating current from batteries that power the mobile devices. Lower operating current extends battery life of battery-operated mobile devices, such as smartphones, tablet computers, ultrabooks, and the like.

BRIEF DESCRIPTION OF THE DRAWINGS

For a more complete understanding of the present embodiments, and the advantages thereof, reference is now made to the following descriptions taken in conjunction with the accompanying drawings, in which.

DETAILED DESCRIPTION OF ILLUSTRATIVE EMBODIMENTS

The making and using of the present embodiments are discussed in detail below. It should be appreciated, however, that the present disclosure provides many applicable inventive concepts that can be embodied in a wide variety of specific contexts. The specific embodiments discussed are merely illustrative of specific ways to make and use the disclosed subject matter, and do not limit the scope of the different embodiments.

Embodiments will be described with respect to a specific context, namely bandgap reference circuits and related methods. Other embodiments may also be applied, however, to other types of bias circuits.

Throughout the various figures and discussion, like reference numbers refer to like objects or components. Also, although singular components may be depicted throughout some of the figures, this is for simplicity of illustration and ease of discussion. A person having ordinary skill in the art will readily appreciate that such discussion and depiction can be and usually is applicable for many components within a structure.

In the following disclosure, a novel bandgap reference circuit and method are introduced. The bandgap reference circuit uses a negative temperature dynamic load to provide low voltage operation, low power consumption, small area, temperature compensation, and low line sensitivity.

Figure 1:
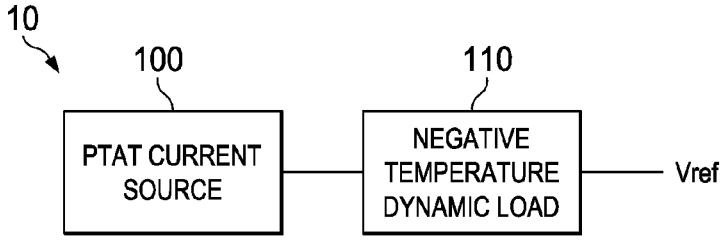
FIG. 1 is a diagram showing a bandgap reference circuit in accordance with various embodiments of the present disclosure.

FIG. 1 is a diagram showing a bandgap reference circuit 10 in accordance with various embodiments of the present disclosure. A proportional to absolute temperature (PTAT) current source 100 is electrically connected to a negative temperature dynamic load 110. Reference voltage Vref of the bandgap reference circuit 10 is generated by the negative temperature dynamic load 110.

Figure 2:
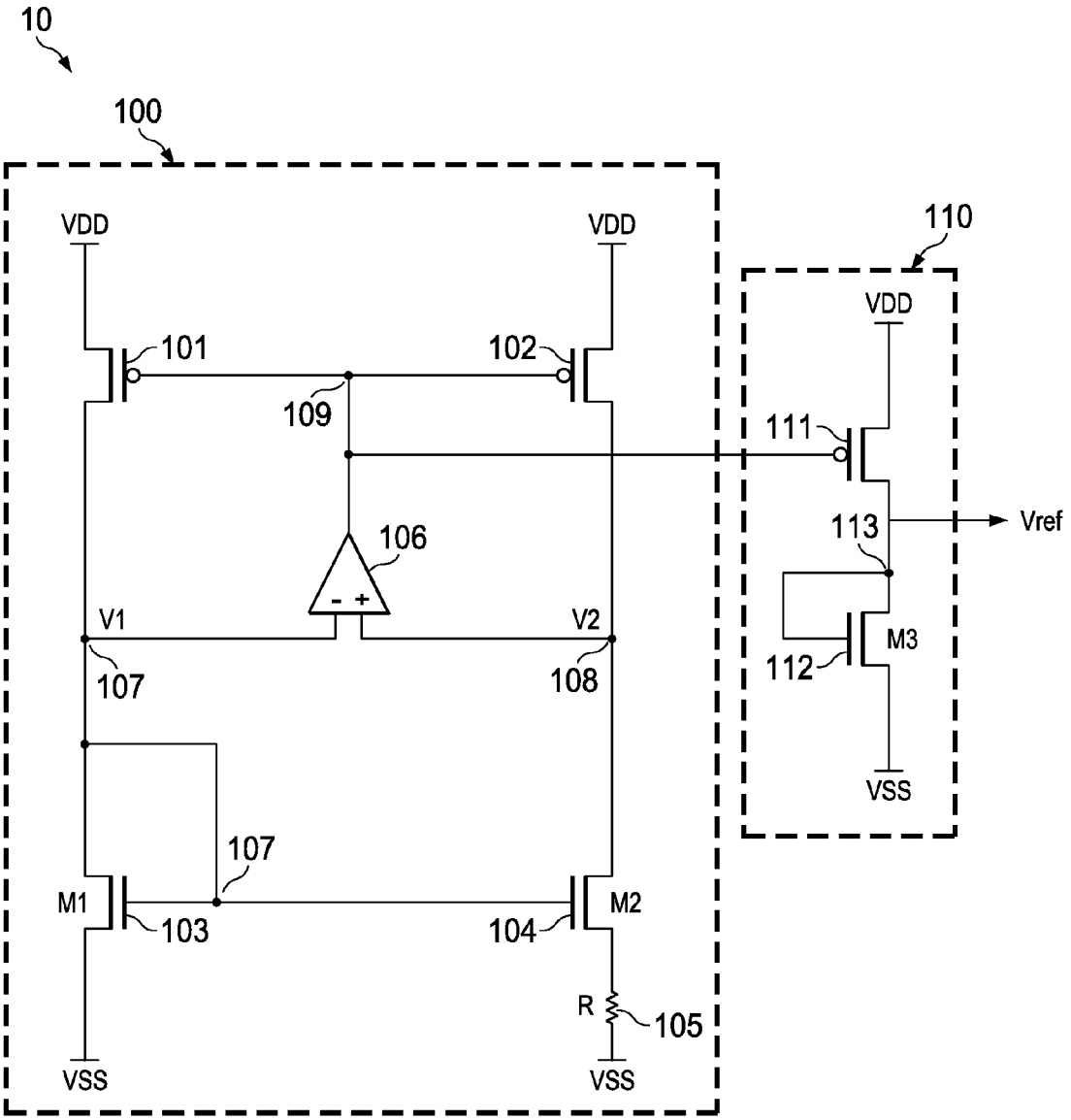
FIG. 2 is a circuit schematic diagram of the bandgap reference circuit in accordance with various embodiments of the present disclosure.

FIG. 2 is a circuit schematic diagram of the bandgap reference circuit 10 in accordance with various embodiments of the present disclosure. The bandgap reference circuit 10 is biased by a first power supply voltage VDD (e.g., 1.8 Volts, 0.9 Volts, or the like), and a second power supply voltage VSS (e.g., 0 Volts, −0.45 Volts, −0.9 Volts, or the like).

A source electrode of a first transistor 101 of the PTAT current source 100 is electrically connected to a first power node biased by the first power supply voltage VDD. A drain electrode of the first transistor 101 is electrically connected to a node 107. A gate electrode of the first transistor 101 is electrically connected to a node 109 (corresponding to an output node of comparator or error amplifier 106). In some embodiments, the first transistor 101 is a P-type metal-oxide-semiconductor (PMOS) transistor.

A source electrode of a second transistor 102 of the PTAT current source 100 is electrically connected to the first power node biased by the first power supply voltage VDD. A drain electrode of the second transistor 102 is electrically connected to a node 108. A gate electrode of the second transistor 102 is electrically connected to the node 109. In some embodiments, the second transistor 102 is a PMOS transistor.

A source electrode of a third transistor 103 of the PTAT current source 100 is electrically connected to a second power node biased by the second power supply voltage VSS. A drain electrode of the third transistor 103 is electrically connected to the node 107. A gate electrode of the third transistor 103 is electrically connected to the node 107. In some embodiments, the third transistor 103 is an N-type metal-oxide-semiconductor (NMOS) transistor.

A source electrode of a fourth transistor 104 of the PTAT current source 100 is electrically connected to a second power node biased by the second power supply voltage VSS through a resistor 105. A first terminal of the resistor 105 is electrically connected to the source electrode of the fourth transistor 104. A second terminal of the resistor 105 is electrically connected to the second power node. A drain electrode of the fourth transistor 104 is electrically connected to the node 108. A gate electrode of the fourth transistor 104 is electrically connected to the node 107. In some embodiments, the fourth transistor 104 is an NMOS transistor.

A non-inverting input terminal of an amplifier 106 is electrically connected to the node 108. An inverting input terminal of the amplifier 106 is electrically connected to the node 107. An output terminal of the amplifier 106 is electrically connected to the node 109. In some embodiments, the amplifier 106 is an operational amplifier.

The negative temperature dynamic load 110 has an input terminal electrically connected to the node 109, and outputs the reference voltage Vref at a node 113. A source electrode of a fifth transistor 111 of the negative temperature dynamic load 110 is electrically connected to the first power node biased by the first power supply voltage VDD. A drain electrode of the fifth transistor 111 is electrically connected to the node 113. A gate electrode of the fifth transistor 111 is electrically connected to the node 109. In some embodiments, the fifth transistor 111 is a PMOS transistor.

A source electrode of a sixth transistor 112 of the PTAT current source 100 is electrically connected to the second power node biased by the second power supply voltage VSS. A drain electrode of the sixth transistor 112 is electrically connected to the node 113. A gate electrode of the sixth transistor 112 is electrically connected to the node 113. The sixth transistor 112 is an NMOS transistor.

In some embodiments, the third, fourth and sixth transistors 103, 104, 112 are long-channel transistors. For example, in a process node having critical dimension (CD) of 40 nanometers, length of the third, fourth and sixth transistors 103, 104, 112 may be greater than about 0.1 micrometers.

In some embodiments, aspect ratio (width over length) of the fourth transistor 104 is an integer multiple of aspect ratio of the third transistor 103. In some embodiments, the integer multiple is greater than 1. In some embodiments, the integer multiple is in a range of about 2 to about 30.

The bandgap reference circuit 10 generates the reference voltage Vref substantially according to the following relationship:

$$Vref = \sqrt{\frac{2nV_T}{R\mu C_{ox}\frac{W_3}{L_3}}\ln\left(\frac{W_2L_1}{W_1L_2}\right)} + Vth$$

where n is an ideality factor, $V_T$ is thermal voltage (kT/q), R is resistance of the resistor 105, μ is electron mobility, $C_{ox}$ is oxide capacitance per unit area, $W_3$ is width of the sixth transistor 112, $L_3$ is length of the sixth transistor 112, $W_2$ is width of the fourth transistor 104, $L_2$ is length of the fourth transistor 104, $W_1$ is width of the third transistor 103, $L_1$ is length of the third transistor 103, and Vth is threshold voltage of the sixth transistor 112. The ideality factor n is related to proportion of current that is diffusion current versus conduction current. Various terms in the above relationship have positive or negative temperature correlation. The thermal voltage $V_T$ and the inverse of electron mobility 1/μ contribute positive temperature correlation to the reference voltage Vref. The threshold voltage Vth contributes negative temperature correlation to the reference voltage Vref. Proper adjustment of R and M1, M2 and M3 device size or aspect ratio makes the first term of the Vref formula more or less sensitive to positive temperature. The positive temperature effect term may be designed to be larger or smaller to compensate for fixed and negative temperature effect term, Vth (the second term of the formula). The reference voltage Vref can be controlled by proper design of the length $L_3$, the resistance R, and the threshold voltage Vth (via bias current of the sixth transistor 112).

The bias current (drain current) of the sixth transistor 112 is mirrored by the fifth transistor 111 from the node 109. Drain current $I_{D2}$ of the second and fourth transistors 102, 104 is determined by gate-source voltages $V_{GS1}$, $V_{GS2}$ of the third and fourth transistors 103, 104, and resistance R of the resistor 105. Namely, the drain current $I_{D2}$ can be expressed as:

$$I_{D2} = \frac{(V_{GS1} - V_{GS2})}{R}$$

In some embodiments, the resistance R of the resistor 105 is in a range such that the difference term ($V_{GS1}$-$V_{GS2}$) is less than about 55 millivolts. In some embodiments, the difference term ($V_{GS1}$-$V_{GS2}$) is less than or equal to 50 millivolts. In some embodiments, the aspect ratio $W_2/L_2$ is greater than the aspect ratio $W_1/L_1$ by a factor of about 2 to about 30. In some embodiments, the aspect ratio of the fifth transistor 111 is substantially equal to the aspect ratio of the second transistor 102. In some embodiments, the aspect ratio of the fifth transistor 111 is greater than the aspect ratio of the second transistor 102.

Figure 3:
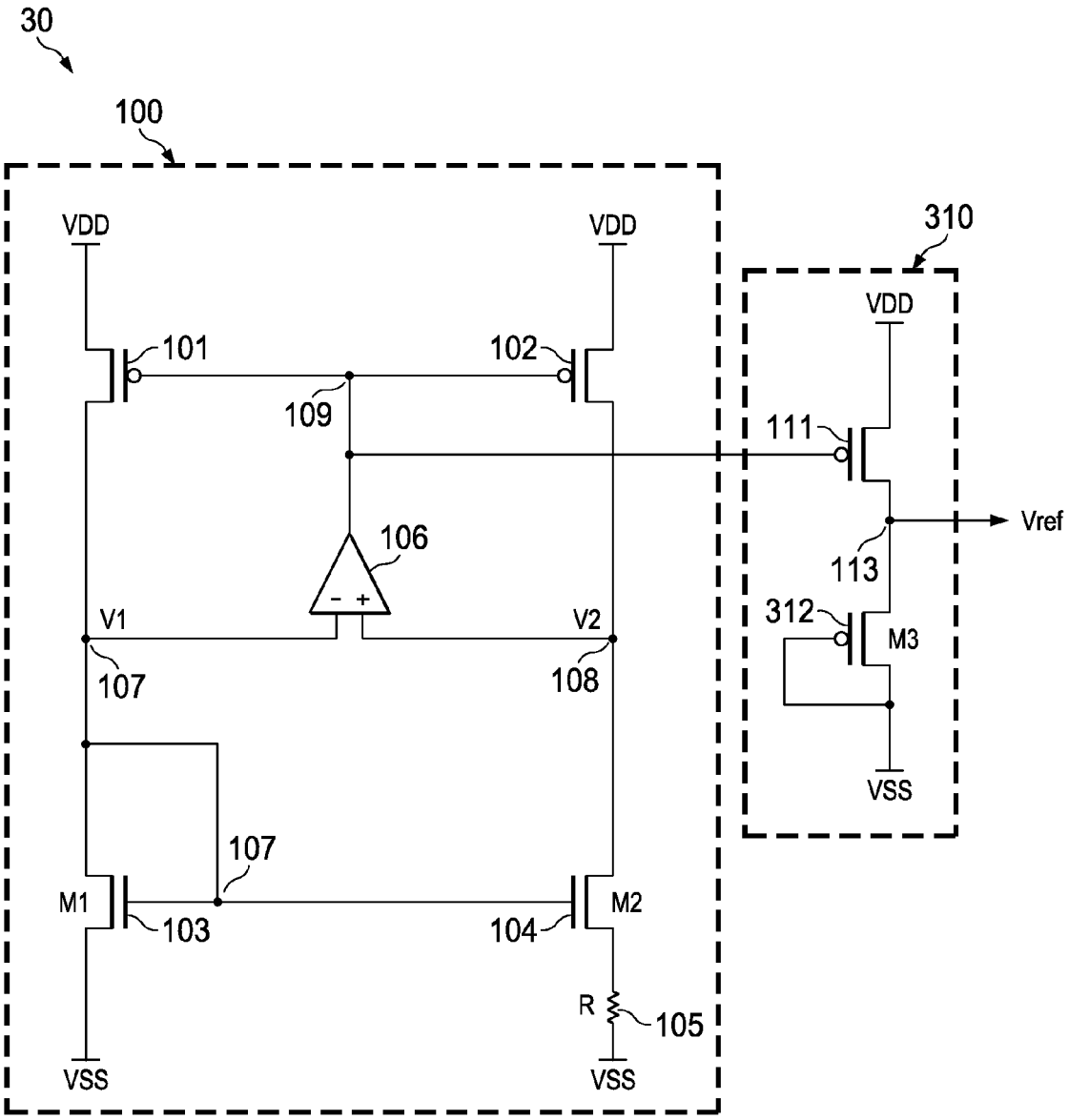
FIG. 3 is a circuit schematic diagram of a bandgap reference circuit in accordance with various embodiments of the present disclosure.

FIG. 3 is a circuit schematic diagram of a bandgap reference circuit 30 in accordance with various embodiments of the present disclosure. The bandgap reference circuit 30 is similar to the bandgap reference circuit 10, with like reference numerals referring to like components. A negative temperature dynamic load 310 similar to the negative temperature dynamic load 110 is electrically connected to the PTAT current source 100. A source electrode of a seventh transistor 312 is electrically connected to the node 113. Drain and gate electrodes of the seventh transistor 312 are electrically connected to the second power node. The seventh transistor 312 is a PMOS transistor.

The bandgap reference circuit 30 generates the reference voltage Vref substantially according to the following relationship:

$$Vref = \sqrt{\frac{2nV_T}{R\mu C_{ox}\frac{W_3}{L_3}}\ln\left(\frac{W_2L_1}{W_1L_2}\right)} + |Vth|$$

where n is an ideality factor, $V_T$ is thermal voltage (kT/q), R is resistance of the resistor 105, μ is electron mobility, $C_{ox}$ is oxide capacitance per unit area, $W_3$ is width of the sixth transistor 112, $L_3$ is length of the sixth transistor 112, $W_2$ is width of the fourth transistor 104, $L_2$ is length of the fourth transistor 104, $W_1$ is width of the third transistor 103, $L_1$ is length of the third transistor 103, and |Vth| is absolute threshold voltage of the PMOS seventh transistor 312. The ideality factor n is related to proportion of current that is diffusion current versus conduction current. Various terms in the above relationship have positive or negative temperature correlation. The thermal voltage $V_T$ and the inverse of electron mobility 1/μ contribute positive temperature correlation to the reference voltage Vref. The threshold voltage |Vth| contributes negative temperature correlation to the reference voltage Vref. Proper adjustment of R and M1, M2 and M3 device size or aspect ratio makes the first term of the Vref formula more or less sensitive to positive temperature. The positive temperature effect term may be designed to be larger or smaller to compensate for fixed and negative temperature effect term, Vth (the second term of the formula). The reference voltage Vref can be controlled by proper design of at least the length $L_3$, the resistance R, and the threshold voltage |Vth| (via bias current of the seventh transistor 312).

The bias current (drain current) of the sixth transistor 112 is mirrored by the fifth transistor 111 from the node 109. Drain current $I_{D2}$ of the second and fourth transistors 102, 104 is determined by gate-source voltages $V_{GS1}$, $V_{GS2}$ of the third and fourth transistors 103, 104, and resistance R of the resistor 105. Namely, the drain current $I_{D2}$ can be expressed as:

$$I_{D2} = \frac{(V_{GS1} - V_{GS2})}{R}$$

In some embodiments, the resistance R of the resistor 105 is in a range such that the difference term ($V_{GS1}$-$V_{GS2}$) is less than about 55 millivolts. In some embodiments, the difference term ($V_{GS1}$-$V_{GS2}$) is less than or equal to 50 millivolts. In some embodiments, the aspect ratio $W_2/L_2$ is greater than the aspect ratio $W_1/L_1$ by a factor of about 2 to about 7. In some embodiments, the aspect ratio of the fifth transistor 111 is substantially equal to the aspect ratio of the second transistor 102. In some embodiments, the aspect ratio of the fifth transistor 111 is greater than the aspect ratio of the second transistor 102.

Figure 4:
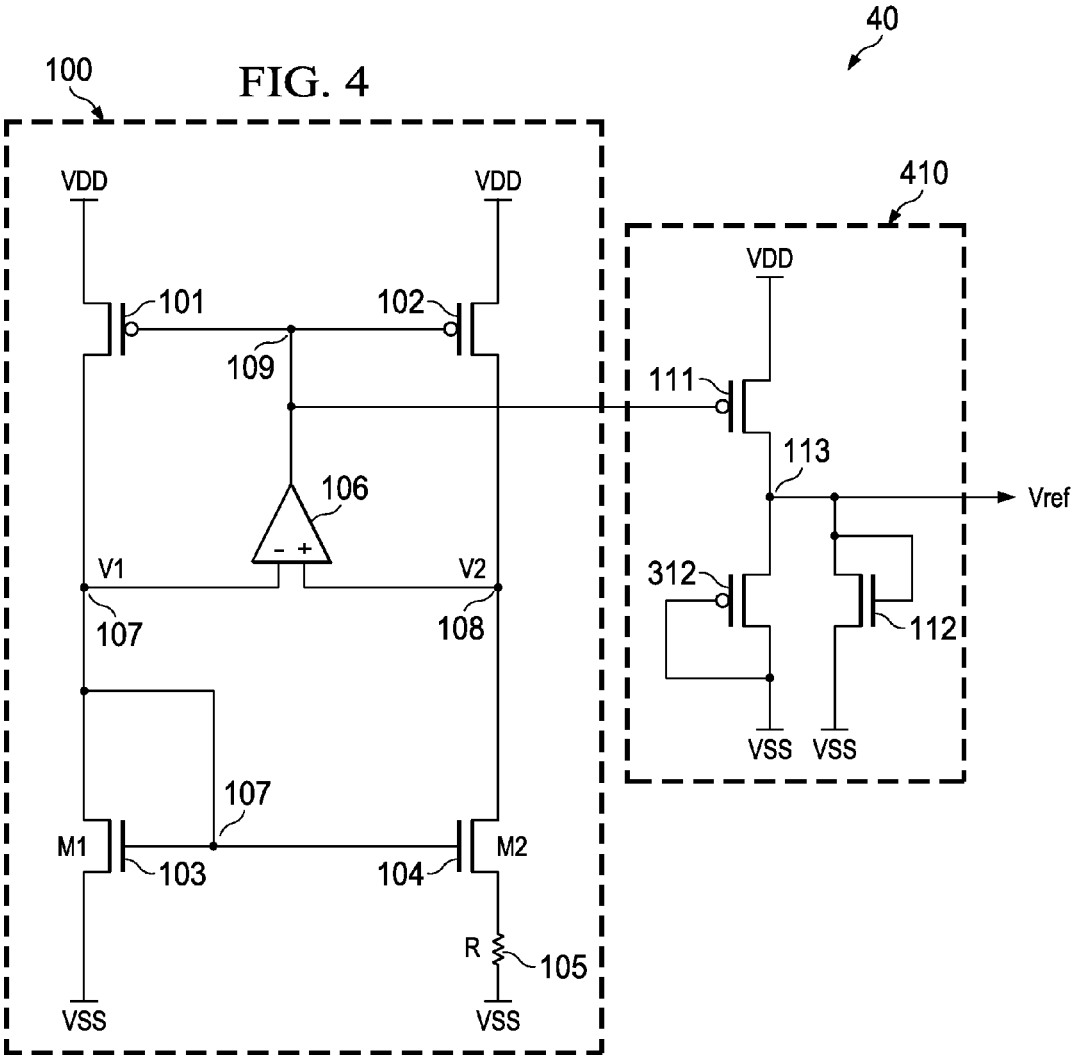
FIG. 4 is a circuit schematic diagram showing a bandgap reference circuit in accordance with various embodiments of the present disclosure.

FIG. 4 is a circuit schematic diagram showing a bandgap reference circuit 40 in accordance with various embodiments of the present disclosure. The bandgap reference circuit 40 is similar to the bandgap reference circuits 10, 30, with like reference numerals referring to like components. A negative temperature dynamic load 410 similar to the negative temperature dynamic loads 110, 310 is electrically connected to the PTAT current source 100. As shown, the negative temperature dynamic load 410 includes both the sixth transistor 112 and the seventh transistor 312. The bandgap reference circuit 40 has good insensitivity to skewed process corners (e.g., slow-fast or fast-slow corners).

Figure 5:
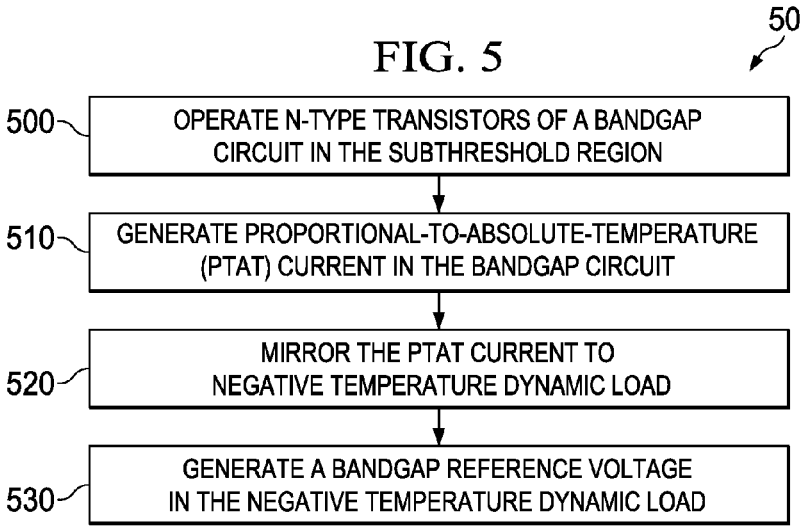
FIG. 5 is a flowchart of a process for generating a bandgap voltage in accordance with various embodiments of the present disclosure.

FIG. 5 is a flowchart of a process 50 for generating a bandgap voltage (e.g., the reference voltage Vref) in accordance with various embodiments of the present disclosure. The process 50 may be performed by any of the bandgap circuits 10, 30, 40. N-type transistors of the bandgap circuit are operated 500 in the subthreshold region. In some embodiments, the bandgap circuit is biased by a voltage (VDD−VSS) in a range from about two threshold voltages (2*Vth) to a metal-oxide-semiconductor (MOS) breakdown voltage. For example, in a 28 nanometer CMOS process, the threshold voltage Vth may be about 0.35 Volts. The voltage (VDD−VSS) may then be in a range of about 0.7 Volts to about 5 Volts. In more advanced processes, the threshold voltage may be lower, and the voltage (VDD−VSS) may be in an even lower range (e.g., 0.5 Volts to 1.5 Volts).

A PTAT current is generated 510 in the bandgap circuit. In some embodiments, the PTAT current is generated 510 through operation of current source transistors (e.g., the first and second transistors 101, 102), an amplifier (e.g., the amplifier 106), the subthreshold N-type transistors (e.g., the third and fourth transistors 103, 104), and a resistor (e.g., the resistor 105).

The PTAT current is mirrored 520 to a negative temperature dynamic load (e.g., any of the negative temperature dynamic loads 110, 310, 410). In some embodiments, the mirroring 520 is performed by biasing the gate electrode of the fifth transistor 111 by the voltage at the node 109. In some embodiments, the mirroring 520 is by the fifth transistor 111 having the aspect ratio substantially equal to the aspect ratio of the second transistor 102, or greater than the aspect ratio of the second transistor 102.

A bandgap reference voltage (e.g., the reference voltage Vref) is generated 530 in the negative temperature dynamic load. In some embodiments, the fifth transistor 111 generates drain current in the sixth transistor 112, the seventh transistor 312, or the sixth and seventh transistors 112, 312. Gate-source voltage $V_{GS}$ (e.g., for the sixth transistor 112) or source-gate voltage $V_{SG}$ (e.g., for the seventh transistor 312) is dependent on the drain current generated by the fifth transistor 111.

Embodiments may achieve advantages. The third and fourth transistors 103, 104 operated in the subthreshold region allow for very low power supply voltage (VDD−VSS). The negative temperature dynamic load 110, 310, or 410 requires very little area, and provides temperature compensation as well as excellent regulation (line sensitivity).

In accordance with various embodiments of the present disclosure, a device includes a proportional-to-absolute-temperature (PTAT) current source having a bandgap reference voltage node, and a negative temperature dynamic load having an input terminal electrically connected to the bandgap reference voltage node.

In accordance with various embodiments of the present disclosure, a method includes (a) operating N-type transistors of a bandgap circuit in a subthreshold region; (b) generating proportional-to-absolute-temperature (PTAT) current in the bandgap circuit; (c) mirroring the PTAT current to a negative temperature dynamic load; and (d) generating a bandgap reference voltage in the negative temperature dynamic load.

As used in this application, "or" is intended to mean an inclusive "or" rather than an exclusive "or". In addition, "a" and "an" as used in this application are generally be construed to mean "one or more" unless specified otherwise or clear from context to be directed to a singular form. Also, at least one of A and B and/or the like generally means A or B or both A and B. Furthermore, to the extent that "includes", "having", "has", "with", or variants thereof are used in either the detailed description or the claims, such terms are intended to be inclusive in a manner similar to the term "comprising". Moreover, the term "between" as used in this application is generally inclusive (e.g., "between A and B" includes inner edges of A and B).

Although the present embodiments and their advantages have been described in detail, it should be understood that various changes, substitutions, and alterations can be made herein without departing from the spirit and scope of the disclosure as defined by the appended claims. Moreover, the scope of the present application is not intended to be limited to the particular embodiments of the process, machine, manufacture, composition of matter, means, methods, and steps described in the specification. As one of ordinary skill in the art will readily appreciate from the disclosure, processes, machines, manufacture, compositions of matter, means, methods, or steps, presently existing or later to be developed, that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

What is claimed is:

1. A device comprising:

a proportional-to-absolute-temperature (PTAT) current source comprising:

an amplifier having an output terminal;

a first transistor configured to be operated in a subthreshold region, and electrically connected to an inverting input terminal of the amplifier;

a second transistor configured to be operated in the subthreshold region, and electrically connected to a non-inverting input terminal of the amplifier, and the first transistor, wherein the first transistor and the second transistor share a common gate connected to the inverting input terminal of the amplifier; and a resistor having a first terminal electrically connected to the second transistor, and a second terminal electrically connected to a first power supply node; and a negative temperature dynamic load contributing a negative temperature correlation to the voltage of a bandgap reference voltage output node, the negative temperature dynamic load having a single input terminal and a single output terminal, the negative temperature dynamic load including a first load transistor, wherein the first load transistor is an N-type metal-oxide-semiconductor (NMOS) transistor having a first terminal directly connected to the first power supply node, the negative temperature dynamic load having a second load transistor having a gate terminal directly connected to the output of the amplifier and having a first terminal directly connected to a second power supply node, wherein a gate electrode of the first load transistor is electrically connected to a drain electrode of the second load transistor, wherein a drain electrode of the first load transistor is electrically connected to the drain electrode of the second load transistor, wherein a second terminal of the first load transistor and a second terminal of the second load transistor are directly connected together at the bandgap reference voltage output node, wherein the single input terminal is directly connected to the gate terminal of the second load transistor and the single output terminal is directly connected to the bandgap reference voltage output node.

2. The device of claim 1, wherein the first transistor and the second transistor are N-type metal-oxide-semiconductor (NMOS) transistors.

3. The device of claim 1, wherein the negative temperature dynamic load further comprises:

a P-type transistor having:

a source electrode electrically connected to the source electrode of the second load transistor;

a drain electrode electrically connected to the power supply node; and a gate electrode electrically connected to the power supply node.

4. The device of claim 2, wherein the first transistor has a gate-source voltage higher than a gate-source voltage of the second transistor by less than about 55 millivolts.

5. The device of claim 2, wherein an aspect ratio of the second transistor is in a range of about 2 to about 30 times an aspect ratio of the first transistor.

6. A method comprising:

(a) operating N-type transistors of a bandgap circuit in a subthreshold region, wherein the N-type transistors are connected in a common gate configuration, the common gate being connected to an inverting input of an amplifier;

(b) generating proportional-to-absolute-temperature (PTAT) current in the bandgap circuit;

(c) mirroring the PTAT current to a negative temperature dynamic load; and (d) generating a bandgap reference voltage at a common node between a first load transistor and a second load transistor in the negative temperature dynamic load, the first load transistor having a first terminal directly connected to a first power supply node, the negative temperature dynamic load having a second load transistor having a gate terminal directly connected to an output of the bandgap circuit and having a first terminal directly connected to a second power supply node.

7. The method of claim 6, wherein said (d) includes:

generating the bandgap reference voltage by a diode-connected N-type metal-oxide-semiconductor transistor of the negative temperature dynamic load.

8. The method of claim 6, wherein said (d) includes:

generating the bandgap reference voltage by a diode-connected P-type metal-oxide-semiconductor transistor of the negative temperature dynamic load.

9. The method of claim 6, wherein said (a) includes:

operating a first N-type metal-oxide-semiconductor (NMOS) transistor at a first gate-source voltage (VGS); and operating a second NMOS transistor electrically connected to the first NMOS transistor at a second VGS lower than the first VGS by less than about 55 millivolts.

10. The method of claim 7, wherein said (d) further includes:

generating the bandgap reference voltage by a diode-connected P-type metal-oxide-semiconductor transistor of the negative temperature dynamic load.

11. The method of claim 9, wherein said (a) includes:

operating a first N-type metal-oxide-semiconductor (NMOS) transistor in the subthreshold region; and operating a second NMOS transistor electrically connected to the first NMOS transistor and having about 2 to about 30 times aspect ratio of the first NMOS transistor in the subthreshold region.

12. The method of claim 9, further comprising:

powering the bandgap circuit and the negative temperature dynamic load by a power supply voltage in a range of about 2 times a metal-oxide-semiconductor (MOS) threshold voltage to about a MOS breakdown voltage.

13. The method of claim 11, wherein said (c) comprises:

generating a first current in a first P-type metal-oxide-semiconductor (PMOS) transistor of the bandgap circuit; and mirroring the first current to a second PMOS transistor of the negative temperature dynamic load having substantially the same aspect ratio as the first PMOS transistor.

14. A device comprising:

a current source circuit configured to generate a proportional-to-absolute-temperature (PTAT) current, comprising:

a first transistor configured to be operated in a subthreshold region, comprising:

a control terminal;

a first output terminal coupled to a first DC voltage reference; and a second output terminal coupled to the control terminal and an inverting input of an amplifier;

a second transistor configured to be operated in a subthreshold region, comprising:

a control terminal coupled to the control terminal of the first transistor;

a first output terminal coupled to the first DC voltage reference through a passive resistive element; and a second output terminal coupled to the noninverting input of the amplifier;

a negative temperature load circuit configured to provide a bandgap reference voltage, comprising:

an input terminal coupled to the output terminal of the amplifier of the current source circuit;

an input transistor configured to mirror the PTAT current, the input transistor comprising:

a control terminal coupled to the input terminal;

a first output terminal coupled to a second DC voltage reference; and a second output terminal directly coupled to a first output terminal of a first diode-connected transistor and a first output terminal of a second diode-connected transistor, wherein the bandgap reference voltage is provided at a common node directly coupled to the second output terminal of the input transistor and directly coupled to the first output terminal of the first diode-connected transistor and the first output terminal of the second diode-connected transistor.

15. The device of claim 14, wherein a positive temperature effect of the bandgap reference voltage is determined at least in part by one or more of the resistance of the passive resistive element, the size of the first transistor, second transistor, or diode-connected transistor, or the aspect ratio of the first transistor, second transistor, or diode-connected transistor.

16. The device of claim 14, wherein the first diode-connected transistor is a P-type metal-oxide-semiconductor (PMOS) transistor and the second diode-connected transistor is an N-type metal-oxide-semiconductor (NMOS) transistor.

17. The device of claim 14, wherein a second output terminal of the first diode-connected transistor and a second output terminal of the second diode-connected transistor are directly coupled to a third DC voltage reference.

18. The device of claim 14, wherein an aspect ratio of the second transistor is between about 2 times greater to about 30 times greater than an aspect ratio of the first transistor.

19. The device of claim 14, wherein the first transistor has a gate-source voltage that is less than about 55 millivolts higher than a gate-source voltage of the second transistor.

20. The device of claim 14, wherein a negative temperature effect of the bandgap reference voltage is determined at least in part by the threshold voltage of the diode-connected transistor.

* * * * *